US005596165A

United States Patent [19]

Carney

[11] Patent Number: 5,596,165

[45] Date of Patent: Jan. 21, 1997

[54] BLASTING METHOD AND COMPOSITION

[76] Inventor: Patrick Carney, 1080 Nowata, Dubuque, Iowa 52001

[21] Appl. No.: 117,427

[22] Filed: Sep. 7, 1993

Related U.S. Application Data

[63] Continuation of Ser. No. 827,413, Jan. 29, 1992, Pat. No. 5,261,327.

[51] Int. Cl.[6] ..... F42B 3/00; A45C 13/10

[52] U.S. Cl. ..... 102/312; 102/313; 102/289; 149/124; 149/46; 149/76

[58] Field of Search ..... 149/46, 76, 124; 102/312, 313, 289

[56] References Cited

U.S. PATENT DOCUMENTS

| | | | |
|---|---|---|---|
| Re. 33,788 | 1/1992 | Clay | 149/1 |
| 3,881,970 | 5/1975 | Falconer et al. | 149/76 X |
| 4,012,246 | 3/1977 | Forrest | 149/47 |
| 4,042,431 | 8/1977 | Friant et al. | 149/36 |
| 4,132,574 | 1/1979 | Forrest | 149/2 |
| 4,161,142 | 7/1979 | Edwards et al. | 102/23 |
| 4,360,233 | 11/1982 | Ricketts | 299/2 |
| 4,440,447 | 4/1984 | Ricketts et al. | 299/2 |
| 4,490,196 | 12/1984 | Funk | 149/92 |
| 4,555,279 | 11/1985 | Funk | 149/92 |
| 4,560,206 | 12/1985 | Ricketts | 299/2 |
| 4,614,146 | 9/1986 | Ross et al. | 86/20 |
| 4,619,721 | 10/1986 | Cescon et al. | 149/21 |
| 4,685,375 | 8/1987 | Ross et al. | 86/20.15 |
| 4,693,765 | 9/1987 | Stromquist et al. | 11/46 X |
| 4,853,050 | 8/1989 | Bates et al. | 149/2 |
| 4,936,933 | 6/1990 | Yabsley et al. | 149/109.6 |
| 5,071,496 | 12/1991 | Coursel et al. | 149/21 |
| 5,076,867 | 12/1991 | McKenzie | 149/2 |
| 5,151,138 | 9/1992 | Lownds | 149/21 |
| 5,348,596 | 9/1994 | Goleniewski et al. | 11/19.6 |

OTHER PUBLICATIONS

Report No.: AFRPL–TR–82–072 entitled Solid Propellant Solid Reclamation Study dated Nov. 1982 Authors: M. P. Coover & L. W. Poulter Prepared for the: Air Force Focket Propulsion Laboratory.

*Primary Examiner*—Peter A. Nelson
*Attorney, Agent, or Firm*—Roper & Quigg

[57] ABSTRACT

A method and composition for blasting wherein boreholes are loaded with pre-determined quantities of a high velocity explosive and a low velocity explosive. The high velocity explosive extends in a substantially continuous matter for a pre-determined length along the borehole column and a low velocity propellant is placed at pre-determined locations within the high velocity explosive column such that the high velocity explosive detonates substantially along its length in the column thus initiating a low velocity explosion at various predetermined points at the location of the low velocity explosive. The resulting explosion produces minimum ground vibration and air shock waves while substantially breaking and casting the rock material with minimal flyrock.

10 Claims, No Drawings

BLASTING METHOD AND COMPOSITION

This application is a continuation of my application Ser. No. 07/827,413, filed Jan. 29, 1992, and now U.S. Pat. No. 5,261,327.

BACKGROUND OF THE INVENTION

Quarry blasting for rock, such as limestone, granite, and other igneous rocks conventionally uses ANFO as the explosive. ANFO is a mixture of approximately 94% ammonium nitrate and 6% fuel oil.

In quarry blasting, a plurality of boreholes are drilled in a predetermined pattern or array. For example, the holes are drilled on a 10 foot×10 foot pattern, with 3–9 inch diameters and depths of 20–90 feet. A cast booster with a blasting cap is placed in the bottom of the hole, and ANFO is added into the hole up to level approximately eight feet from the surface. Small rock chips from ¼ inch–½ inch in size, commonly called stemming, are placed in the top of the hole to confine the ANFO. The boreholes are detonated sequentially so as to provide free faces toward which the broken rock moves.

The energy and powder factors vary, depending upon the geological structures being blasted. For example, limestone requires a powder factor of 2–5 pounds per ton.

ANFO is also used in open pit mining, for such minerals as taconite, copper and gold. In open pit mines, the boreholes are typically 10–15 inches in diameter, drilled in a 28×28 foot pattern to produce 40–60 foot faces. Powder factors vary from 0.53–0.85 pounds per yard.

ANFO is a popular explosive in both quarry mining and open pit mining due to its low cost. However, ANFO has several limitations. When the boreholes are filled with solid columns of ANFO, only 60–70% efficiency is achieved as the detonation rises in the borehole. Accordingly, in such a straight ANFO shot, the 30–40% waste must be considered to avoid oversize material which is detrimental to the digging and crushing equipment used after the blast to process the shot rock. Also, such waste increases the cost of producing the shot rock.

Numerous methods have been developed to overcome the inefficiencies of a solid ANFO shot and to enhance the action of ANFO in the borehole. The most common method is alternate velocity loading, wherein cartridges of dynamite or emulsion are alternatingly layered with ANFO in the column. The use of these high explosives contributes to a more complete reaction of the ANFO, due to higher pressures and temperatures near these booster cartridges. This alternate velocity loading produces better fragmentation of the rock, and allows for expanded borehole drill patterns, both of which decrease the cost of the shot rock produced. However, there are physical and environmental hazards associated with the use of alternative velocity loading.

Alternate velocity loading produces excessive fly rock, which is the wild uncontrolled throw of rock from the detonation. Fly rock results from overloading of the holes, lack of burden or confinement, and structural abnormalities in the rock being blasted. Fly rock is the number one killer in quarry operations.

Another problem of alternate velocity loading is excessive ground vibrations and air blast noise. Vibration and noise carry to areas surrounding the quarry site, and therefore, must be minimized to avoid damage to property.

Alternate velocity loading also increases the cost of the shot rock, due to the increased expense of the emulsion and/or dynamite. Solid AP propellant has been manufactured for many years, but has not been used in blasting operations due to its expense. This AP-type propellent is a mixture of approximately 70% ammonium perchlorate, 20% aluminum and 10% binder. AP-type propellent is a low velocity, class B explosive, as compared to dynamite which is a high velocity, class A explosive. Solid composite 1.3 propellants typically have been used as rocket fuel, such as in the Minuteman missiles. Nuclear disarmament treaties, such as SALT and START, require that such missiles be disarmed, including the destruction of the propellant. Much AP propellant manufactured for other uses has reached its designated shelf life, and also must be destroyed, along with scrap propellant from the manufacturing process. In the past, the propellant has been disposed of by open air firing of the propellant motors, or open burning of the propellant. However, these methods of disposal are no longer viable due to stringent Environmental Protection Agency pollution regulations.

Accordingly, a primary objective of the present invention is the provision of an improved blasting method and composition for blasting operations such as quarries, demolitions and the like.

Another objective of the present invention is the provision of a blasting method utilizing detonating explosives, such as ANFO and slurries, including emulsions, HEAVY ANFO, water gels and the like, and solid AP propellant, preferably composite 1.3 propellant.

A further objective of the present invention is the provision of a blasting method having improved fragmentation of shot rock, and decreased fly rock, ground vibration and noise.

Still a further objective of the present invention is the provision of an improved blasting operation which relies upon heat and gas pressure, as opposed to detonation velocity, for producing high quality shot rock.

Yet another objective of the present invention is a blasting composition which utilizes solid propellant to enhance the effect of ANFO.

Another objective of the present invention is the utilization of a solid propellant waste material having environmental liabilities as a useful blasting product and procedure.

A further objective of the present invention is the provision of a blasting method and composition which is safe and economical to use.

These and other objectives will become apparent from the following description of the invention.

SUMMARY OF THE INVENTION

The new and improved blasting composition and method of quarry blasting of the present invention utilizes a high velocity explosive, such as ANFO, and a low velocity explosive, preferably solid AP propellant, in a predetermined pattern of boreholes. A primary charge is placed in the bottom of each borehole and covered with a layer of ANFO. Solid AP propellant and ANFO are then alternatingly placed in the borehole. Stemming material is used to cover the last layer of ANFO and to fill the last several feet of the borehole. The boreholes are wired in series so as to be sequentially detonated. The use of AP propellant in conjunction with the ANFO enhances the detonation of the ANFO, and produces increased gas pressures and temperatures to produce a well-fragmentized rock product with minimal fly rock, noise and vibration.

DESCRIPTION OF THE PREFERRED EMBODIMENT

A solid 1.3 AP propellant from rocket motors or other sources is cut or crushed to a suitable size. This is an ammonium perchlorate based Class B, low explosive which yields a high gas pressure. It is well known that in the rocket propulsion industry, substantial engineering effort goes into producing a formulation which has an exact balance of fuel and oxidizer so that there is no residual that would detract from the payload weights. This 1.3 rocket propellant material is known to be especially effective in providing a self-sustained, high-energy reaction that substantially deflagrates rather than detonates.

In accordance with the present invention, the AP propellant is mixed, in alternating layers, with ANFO, which is a mixture containing approximately 94% ammonium nitrate and 6% diesel fuel. This mixture of AP propellant and ANFO is preferably in a ratio of 40% propellant and 60% ANFO. Upon detonation of this explosive composition in a borehole, high gas pressure and temperatures are produced, without compression stress wave fronts. The explosion of the composition yields minimal fly rock, ground vibrations, and air noise, while producing a well-fragmented shot rock.

In using this new explosive composition at a quarry or open pit mine, a plurality of boreholes having predetermined diameters and depths are drilled in a predetermined pattern or array. A primary charge, such as a cast booster, is lowered into the bottom of the hole. Leads from the primary charge extend upwardly to the top of the hole and are secured to prevent the leads from falling into the hole.

ANFO is poured into the hole to cover the primary charge to a depth of approximately 12 inches. AP propellant, in either stick or crushed form, is then placed in the hole. An additional 6–8 inches of ANFO is then added on top of the propellant. In the case of stick propellant, the ANFO fills any space between the propellant and the borehole wall. This layering of ANFO and propellant is repeated until the borehole is filled to approximately 10 feet from the surface. An additional 3 feet, approximately, of ANFO is added to the hole. An additional primary charge may be inserted in the hole on top of the ANFO and propellant column. The remaining portion of the hole is filled with stemming to confine the charge.

Generally, a convenient configuration for the propellant is in block form approximately 3 inches by 3 inches in cross-section and 6 inches to 12 inches in length, particularly for boreholes which are 5 inches in diameter. It is desirable to size the propellant block such that most of the block sides contact detonating explosive rather than rock. In the process of pouring ANFO into the borehole, the individual blocks of propellant, with or without protective wrapping, are quickly placed into the ANFO stream so as to have a propellant block at approximately every 2 feet in the explosive column. Thus, the solid propellant blocks are evenly spaced throughout the explosive column in about a 60:40 ratio of detonating ANFO explosive to solid propellant. The optional protective wrapping for the propellant consists of, for example, typical explosive bagging, such as double bagged material having an anti-static liner and an outer weaved 6 mil polyethylene.

The boreholes are usually connected to cause sequential exploding starting nearest the free face. After the normal and appropriate safety precautions are taken, the blast is initiated by actuating the primary charge or charges. There is continuity in the column of ANFO for the length of the charge column thus permitting what is basically a continuous detonation; this in turn initiates the explosion of the propellant present in the column. The 1.3 propellant burning rates deviate from steady state of atmospheric pressures when they are subjected to higher pressures. This property is known as dynamic burning. It is believed that the propellant undergoes dynamic burning and thereby breaks rocks more efficiently.

When propellant is confined in a borehole and surrounded by ANFO or slurries, the detonation pressures of the high velocity explosives seem to accelerate the gas production of the composite propellant. It is believed that the intense heat generated by the deflagrating propellant overdrives the ANFO or slurries to get maximum performance out of the detonation. This compound reaction seems to be why the invention is successful.

In an event, the solid 1.3 propellant enhances the detonation of the ANFO. The deflagrating solid rocket propellant produces a tremendous amount of gas pressure, along with greater power deriving from the density of the propellant of approximately 1.8 grams per cubic centimeter. Thus, the use of propellant increases the power of the reaction in the bore hole, while reducing vibrations and fly rock. The resulting explosion yields high gas pressures and temperatures. The low velocity, high gas pressures, and high temperatures produces well-fragmented rock product, with minimal fly rock, minimal vibration and minimal noise. Also, virtually no waste stream is produced, since the propellant is consumed in the explosion.

The ANFO/propellant composition allows the use of less boreholes, and accordingly, less explosive agents, to produce the same amount of rock, thereby saving on costs while minimizing hazards such as fly rock, noise and vibration. Furthermore, the cost of AP propellant from rocket motors and scrap is significantly less than the cost of dynamite and emulsions normally used in alternative velocity loading, thereby further reducing the cost of producing the rock.

The foregoing description of the preferred embodiments of the present invention is merely exemplary and many modifications and variations are possible in light of the above teachings. It will be obvious to one skilled in the art that a variety of readily available explosives may be used for the explosive agent to detonate in the borehole column which initiates the low-velocity, explosive agent, such as solid propellant, placed at a number of predetermined positions along the explosive column and achieve the desired results of the present inventions.

The foregoing preferred embodiment used ANFO, a widely used blasting agent as the agent which detonates in a borehole; however, a wide variety of detonating explosive agents may be used in lieu of or in partial substitution for ANFO. For example, detonating explosive agents may be slurries such as water-gels, emulsions, and emulsion/ANFO combinations, or granular in form (or combinations thereof). These compositions are well known in the blasting industry. Suitable commercial detonating explosives are high velocity explosives having reaction velocities up to about 3000 to 7000 m/sec. Examples of various compositions that will result in detonating explosive agents are described in *Explosives and Rock Blasting* (Copyright 1987 by Atlas Powder Company, Dallas, Tex.) and in various issued patents, such as U.S. Pat. Nos. 5,071,496; 4,287,010; 4,585,495; 4,619,721 and 4,714,503.

Suitable compositions for the low velocity explosive that deflagrates rather than detonates is solid rocket propellant material comprised of ammonium perchlorates, aluminum powder and a rubber-based binder. These and other solid propellant compositions are known to be suitable low velocity explosive materials which have sub-sonic reaction velocities. This includes, but is not limited to, a wide variety of composite-type propellant compositions comprised of metal fuel and rubbers with various oxidizers, such as ammonium perchlorate, potassium perchlorates, nitronium perchlorates, guanidine perchlorates, nitrogen tetroxide and sodium compounds.

A suitable configuration for the low velocity explosive is block form. The blocks can range, for example, from two to twelve square inches in cross section and two inches to thirty inches in length. However, a variety of other configurations and sizes are suitable for the practice of the present invention. Propellant crushed to smaller sizes will continue to exhibit deflagrating, rather than detonating, properties. However, at smaller particulate sizes particles may begin to detonate to a substantial degree, thus detracting from the desired low shock effects of the present invention. For any particular application, the smallest desirable size for the low velocity agent will vary but can be readily determined by test boreholes containing a specific low velocity explosive of a selected size intermixed with the detonating explosive agent or located at predetermined positions in the borehole column, and measuring the blast energy, shock wave velocity, duration, etc.

The ratio of high velocity explosive to low velocity explosive may vary significantly to obtain the desired results. Although a 60:40 ratio is suitable, it can be varied significantly. The preferred upper limit of the low velocity explosive is where the high velocity explosive fails to detonate for the substantial length of the column. The preferred lower limit for the low velocity explosive is where no improved results occur, such as lowered fly rock, improved heave, etc. The basic objective is to maintain a ratio where the high velocity explosive substantially detonates and the low velocity explosive substantially deflagrates.

In addition to the above, applicant has developed an arrangement for using the deflagrating explosive in wet boreholes. Because of ANFO's poor water resistance, it is not used in quarries that have wet boreholes until the column is loaded above the water level. Traditionally slurries are used in the bottom of the borehole because of their good water resistance. The term slurry includes HANFO (an emulsion/ANFO mixture), emulsions or water gels or any combinations of them. HANFO mixtures can run anywhere from 25% to 75% emulsion to ANFO mixture depending on the circumstances it is used under.

One known way of loading this slurry product is in shot bags filled with the product sealed and dropped down the hole. Alternatively, the slurry product can be pumped into the hole with a special pump or auger truck. Applicant has developed the use of shot bags with (1) high velocity, detonating explosives, in particular a slurry, and (2) deflagrating explosives. Preferably, a composite 1.3 propellant is used as the deflagrating explosive. An AP-type propellant can be used. The high velocity explosive are combined with propellant to obtain the desired results of detonation and deflagration. A 60:40 ratio of high velocity explosive to propellant is suitable.

Applicant uses bags having diameters corresponding to the cross-section of the borehole. For example, for a borehole of slightly greater than 5 inches in diameter, the bag would be about 5 inches in diameter. The bags are made of well-known typical explosive bagging, such as double bagged material having a thick anti-static liner and a thick (6 mil) outer weaved polyethylene. For such 5 inch bags, applicant has used blocks or chunks of propellant which are about 3 inches by 3 inches by 3 inches. However, chunks of other sizes could be suitable. It is preferred to use chunks of propellant of a size allowing the chunks to be surrounded by slurry. The bags are dropped down the borehole to bring the column out of the water. At that level in the column, applicant's conventional loading method described above is used. Applicant has used 18 lbs of 50/50 emulsion-ANFO mix and 12 lbs of propellant to form a 30 pound bag of explosives. This is an effective mixture in this bagged embodiment of the invention. This 60/40 formula basically duplicates the ratio of applicant's dry borehole formulation. However, straight emulsions and water-gels could also be used if desired and in different ratios.

Thus, from the foregoing, it can be seen that all of the stated objectives are accomplished by the present invention.

What is claimed is:

1. A blasting composition used within a borehole comprising: a quantity of a high velocity explosive agent, and a quantity of a low velocity, 1.3 rocket propellant, wherein said high velocity explosive agent includes a chemical composition different than said propellant and wherein said blasting composition is used as at least a non-booster explosive within said borehole.

2. The blasting composition of claim 1 herein the ratio of the high velocity explosive to the low velocity, 1.3 rocket propellant is such that the high velocity explosive substantially detonates and the low velocity, 1.3 rocket propellant substantially deflagrates.

3. The blasting composition of claim 1 wherein the propellant contains ammonium perchlorates as an oxidation ingredient.

4. The blasting composition of claim 1 wherein the high velocity explosive is an ammonium nitrate based material.

5. The blasting composition of claim 1 wherein the high velocity explosive is a slurry.

6. The blasting composition of claim 1 wherein the 1.3 propellant is in a cut form.

7. The blasting composition of claim 1 wherein the 1.3 propellant is in a crushed form.

8. The blasting composition of claim 5 wherein the high velocity explosive is an ammonium nitrate based material.

9. The blasting composition of claim 4 wherein said ammonium nitrate based material comprises ANFO.

10. The blasting composition of claim 4 wherein said ammonium nitrate based material is an emulsion.

* * * * *